US006974336B2

(12) United States Patent
Shindo

(10) Patent No.: US 6,974,336 B2
(45) Date of Patent: Dec. 13, 2005

(54) CONNECTOR ADAPTED TO BE USED FOR TRANSMISSION OF A BALANCED SIGNAL AND SUBSTRATE FOR MOUNTING THE CONNECTOR

(75) Inventor: Takeshi Shindo, Higashiyamato (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/823,025

(22) Filed: Apr. 13, 2004

(65) Prior Publication Data

US 2004/0209496 A1 Oct. 21, 2004

(30) Foreign Application Priority Data

Apr. 16, 2003 (JP) ..... 2003-111567

(51) Int. Cl.[7] ..... H01R 9/09
(52) U.S. Cl. ..... 439/79
(58) Field of Search ..... 439/79, 83, 676, 439/607–610, 941, 71, 66, 61; 174/261

(56) References Cited

U.S. PATENT DOCUMENTS 5,085,601 A * 2/1992 Buchter et al. ..... 439/660
5,364,294 A * 11/1994 Hatch et al. ..... 439/676
5,647,749 A * 7/1997 Atoh et al. ..... 439/79
5,795,191 A 8/1998 Preputnick et al.
5,919,063 A * 7/1999 Wang ..... 439/608
6,328,609 B1 * 12/2001 Ezawa et al. ..... 439/676
6,371,812 B1 * 4/2002 Daikuhara et al. ..... 439/608
6,464,536 B1 * 10/2002 Kobayashi ..... 439/607
6,503,103 B1 * 1/2003 Cohen et al. ..... 439/608

FOREIGN PATENT DOCUMENTS

| | | |
|---|---|---|
| JP | 6-243936 | 9/1994 |
| JP | 2000 68006 | 9/1994 |
| JP | 8018243 | 1/1996 |
| JP | 2000-68007 | 3/2000 |
| JP | 3108239 | 9/2000 |

* cited by examiner

*Primary Examiner*—Alexander Gilman
(74) *Attorney, Agent, or Firm*—Collard & Roe, P.C.

(57) ABSTRACT

In a connector (1) including an insulator (2) and first and second signal contacts (3,4) held by the insulator, each of the first and the second signal contacts includes a fixed portion (3*a*,4*a*) fixed to the insulator, a contacting portion (3*b*,4*b*) connected to one end of the fixed portion and extending in a first direction (A1), a bent portion (3*c*,4*c*) connected to the other end of the fixed portion, a first intermediate portion (3*d*,4*d*) extending from the bent portion in the first direction, a second intermediate portion (3*e*,4*e*) extending from the first intermediate portion in a second direction (A2), and a terminal portion (3*f*,4*f*) extending from the second intermediate portion in the first direction. The first intermediate portions are placed at positions which are different from each other in the second direction. The second intermediate portions are different from each other in the first direction. The bent portions are shaped to make the first and the second signal contacts be substantially equal in total length to each other.

9 Claims, 4 Drawing Sheets

CONNECTOR ADAPTED TO BE USED FOR TRANSMISSION OF A BALANCED SIGNAL AND SUBSTRATE FOR MOUNTING THE CONNECTOR

This application claims priority to prior Japanese application JP 2003-111567, the disclosure of which is incorporated herein by reference.

BACKGROUND OF THE INVENTION

This invention relates to a connector suitable for connection of a transmission line or an electric line for transmitting a balanced signal and a substrate for mounting the connector.

A connector of the type is disclosed, for example, in Japanese Patent (JP-B) No. 3108239 and comprises an insulator and a plurality of pairs of signal contacts (signal contact pairs) held by the insulator. Each of the signal contact pairs are connected to a pair of transmission lines for transmitting a balanced signal.

Each of the signal contacts is formed primarily by press punching. In this case, each signal contact tends to be partially varied in sectional shape. It is therefore difficult to achieve impedance matching between the signal contacts in each of the signal contact pairs.

In case where the adjustment of impedance is essential and indispensable, it is inevitable to change the shape in punching. The change in shape in punching requires a high cost.

SUMMARY OF THE INVENTION

It is therefore an object of the present invention to provide a connector which has an excellent impedance characteristic and which is suitable for transmission of a balanced signal.

It is another object of the present invention to provide a connector which is capable of preventing occurrence of crosstalk between adjacent ones of the above-mentioned signal contact pairs.

It is still another object of the present invention to provide a substrate which is adapted to mount the above-mentioned connector and which is prevented from degradation in impedance characteristic.

Other objects of the present invention will become clear as the description proceeds.

According to one aspect of the present invention, there is provided a connector comprising an insulator and first and second signal contacts held by the insulator, each of the first and the second signal contacts comprising a fixed portion fixed to the insulator, a contacting portion connected to one end of the fixed portion and extending in a first direction, a bent portion connected to the other end of the fixed portion, a first intermediate portion extending from the bent portion in the first direction, a second intermediate portion extending from the first intermediate portion in a second direction perpendicular to the first direction, and a terminal portion extending from the second intermediate portion in the first direction, the first intermediate portion of the first signal contact and the first intermediate portion of the second signal contact being placed at positions which are different from each other in the second direction, the second intermediate portion of the first signal contact and the second intermediate portion of the second signal contact being different from each other in the first direction, the bent portions being shaped to make the first and the second signal contacts be substantially equal in total length to each other.

According to another aspect of the present invention, there is provided a substrate to be connected to the connector according to claim 1, the substrate comprising a plate portion, first and second signal pads disposed on a surface of the plate portion and adapted to be connected to the terminal portions of the first and the second signal contacts, and a ground layer formed inside the plate portion and extending in parallel to the surface of the plate portion over an area except at least those portions faced to the first and the second signal pads in the second direction.

DESCRIPTION OF THE PREFERRED EMBODIMENT

Figure 1:
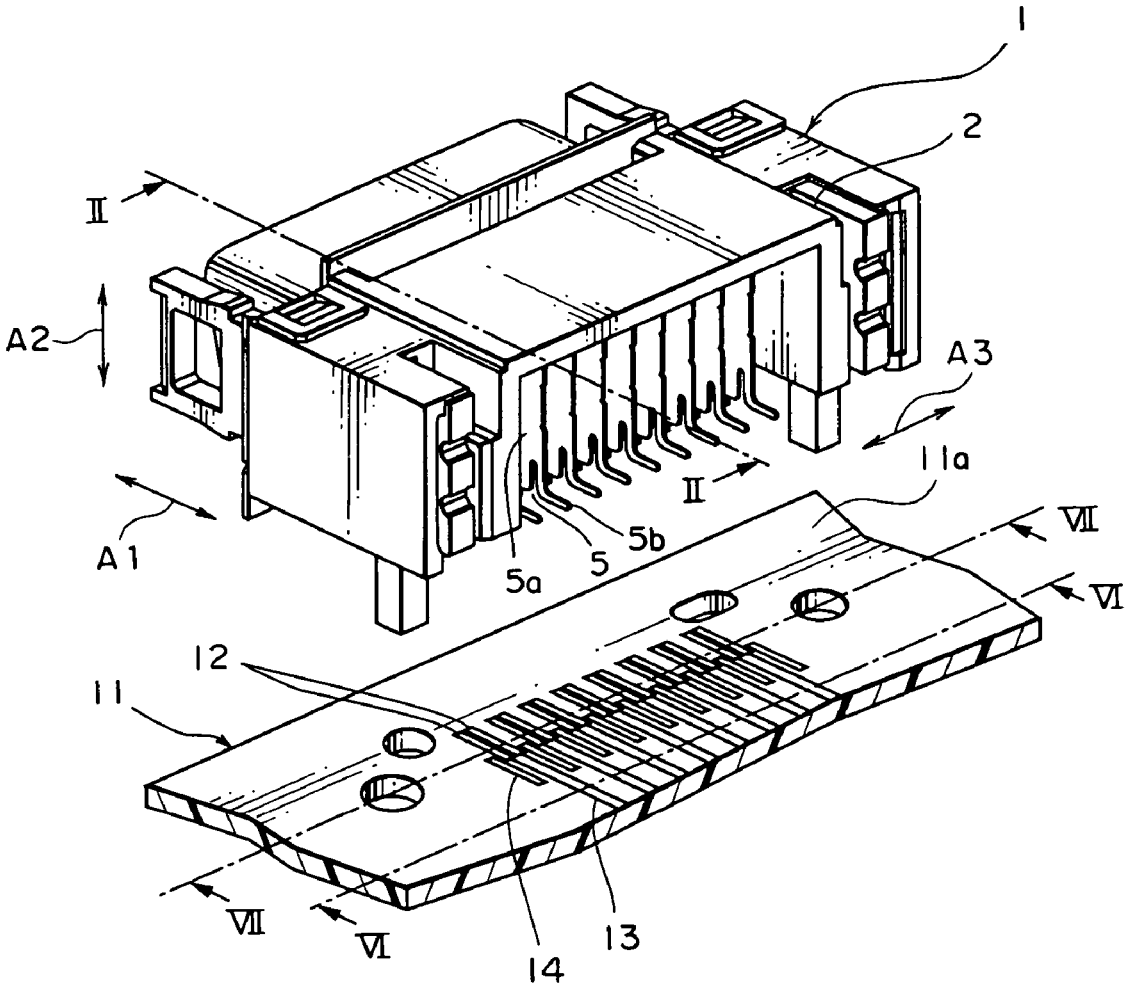
FIG. 1 is a perspective view of a connector according to one embodiment of the present invention, together with a substrate for mounting the connector.
Figure 2:
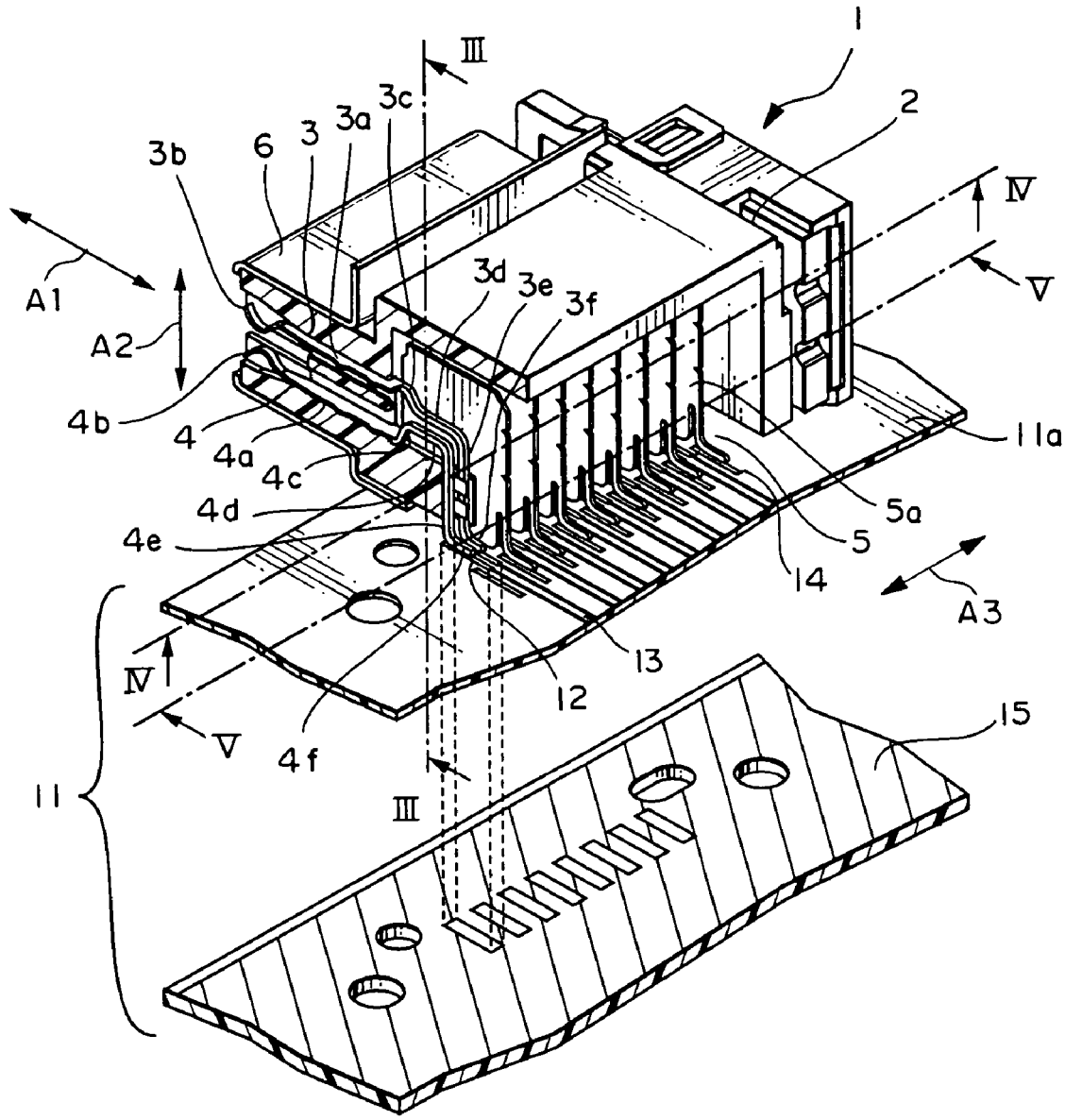
FIG. 2 is a perspective view of the connector illustrated in FIG. 1 with a part cut away along a line II—II, together with the substrate divided into two parts in a thickness direction for convenience of description.

Referring to FIGS. 1 and 2, description will be made of a connector according to one embodiment of the present invention.

The connector depicted by 1 in the figure is a so-called angle connector and is coupled and connected to a mating connector (not shown) in a first direction A1 in order to connect a transmission line for transmitting a balanced signal. The connector 1 is mounted to a substrate 11, such as a printed board, in a second direction A2 perpendicular to the first direction A1. A direction perpendicular to the first and the second directions A1 and A2 will be called a third direction A3.

The connector 1 comprises an insulator 2 and a number of pairs of conductive signal contacts (signal contact pairs) 3 and 4 held by the insulator 2. The signal contact pairs are arranged in parallel to one another at a predetermined pitch in the third direction A3. On opposite sides of every signal contact pair in the third direction A3, conductive ground contacts 5 are disposed adjacent to and spaced from the signal contact pair. Each of the ground contacts 5 extends in the first and the second directions A1 and A2 in a plate-like shape. Each ground contact 5 has a flat plate portion 5*a* press-fitted and fixed to the insulator 2 and a terminal portion 5*b* protruding from the flat plate portion 5*a*. The ground contacts 5 serve to prevent occurrence of crosstalk between the signal contact pairs. The insulator 2 has a coupling portion covered with a shell 6 on upper and lower sides thereof.

In the following description, one of the signal contacts in each pair will be called a first signal contact 3 and the other will be called a second signal contact 4. Each of the first and the second signal contacts 3 and 4 is formed by bending using a press technique and has a generally crank-like shape. Inside the insulator 2, the first signal contact 3 is disposed at a position higher than that of the second signal contact 4 as a whole. The first and the second signal contacts 3 and 4 form an electric pair upon transmission of the balanced signal.

The first signal contact 3 has a fixed portion 3*a* press-fitted and fixed to the insulator 2, a contacting portion 3*b* having elasticity, connected to one end of the fixed portion 3*a*, and extending forward in the first direction A1, i.e., in a coupling direction, a bent portion 3*c* connected to the other end of the fixed portion 3*a*, a first intermediate portion 3*d* extending from the bent portion 3*c* rearward in the first direction A1, a second intermediate portion 3*e* extending from a rear end of the first intermediate portion 3*d* downward in the second direction A2, and a terminal portion 3*f* extending from a lower end of the second intermediate portion 3*e* rearward in the first direction A1 to be soldered to a substrate 11.

On the other hand, the second signal contact 4 has a fixed portion 4*a* press-fitted and fixed to the insulator 2, a contacting portion 4*b* having elasticity, connected to one end of the fixed portion 4*a*, and extending forward in the first direction A1, i.e., in the coupling direction, a bent portion 4*c* connected to the other end of the fixed portion 4*a*, a first intermediate portion 4*d* extending from the bent portion 4*c* rearward in the first direction A1, a second intermediate portion 4*e* extending from a rear end of the first intermediate portion 4*d* downward in the second direction A2, and a terminal portion 4*f* extending from a lower end of the second intermediate portion 4*e* rearward in the first direction A1 to be soldered to the substrate 11.

The contacting portion 3*a* of the first signal contact 3 and the contacting portion 4*a* of the second signal contact 4 are faced to each other with a space left therebetween in the second direction A2. The contacting portions 3*a* and 4*a* form a socket. Between the contacting portions 3*a* and 4*a*, a pin contact of the mating connector is inserted in contact therewith.

Figure 3:
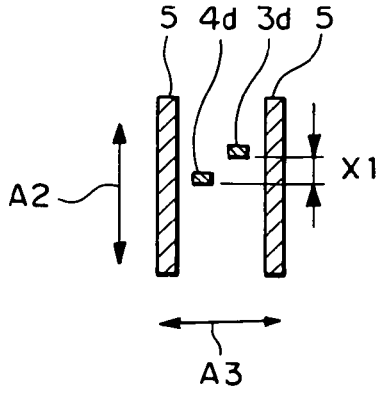
FIG. 3 is a sectional view of a characteristic part of a contact portion, taken along a line III—III in FIG. 2.

As is obvious from FIG. 3, the first intermediate portion 3*d* of the first signal contact 3 and the first intermediate portion 4*d* of the second signal contact 4 are displaced or shifted in position from each other in the second direction A2 by a distance X1 and also displaced or shifted in position from each other in the third direction A3. In other words, the first intermediate portions 3*d* and 4*d* are placed at positions which are different from each other in the second and the third directions A2 and A3.

Figure 4:
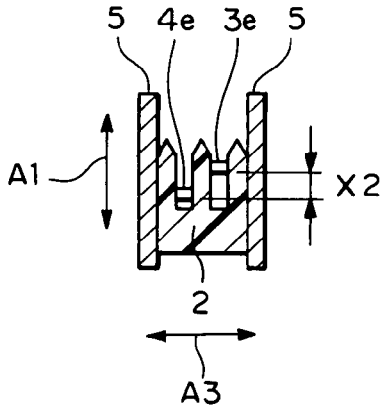
FIG. 4 is a sectional view of a characteristic part of the connector, taken along a line IV—IV in FIG. 2.

As is obvious from FIG. 4, the second intermediate portion 3*e* of the first signal contact 3 and the second intermediate portion 4*e* of the second signal contact 4 are displaced or shifted in position from each other in the first direction A1 by a distance X2 and also displaced or shifted in position from each other in the third direction A3. In other words, the second intermediate portions 3*e* and 4*e* are placed at positions which are different from each other in the first and the third directions A1 and A3.

Figure 5:
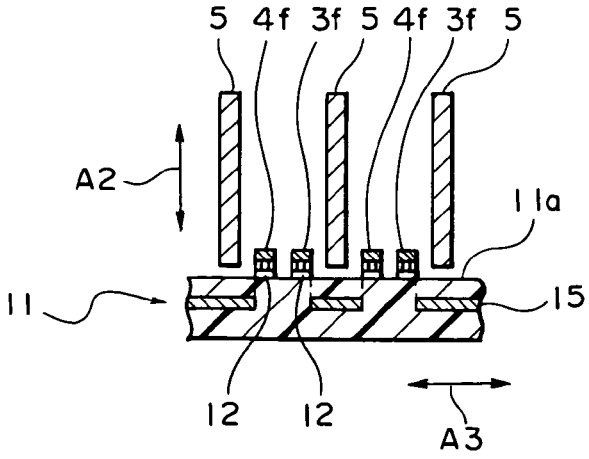
FIG. 5 is a sectional view of a characteristic part, taken along a line V—V in FIG. 2, and shows the relationship between the contact portion and the substrate.

As is obvious from FIG. 5, the terminal portion 3*f* of the first signal contact 3 and the terminal portion 4*f* of the second signal contact 4 are disposed adjacent to each other in the third direction A3.

The bent portion 3*c* of the first signal contact 3 and the bent portion 4*c* of the second signal contact 4 cooperate with each other to make the first and the second signal contacts 3 and 4 be equal in total length to each other. Specifically, by changing the dimensions of the bent portions 3*c* and 4*c* of the first and the second signal contacts 3 and 4, the above-mentioned distances X1 and X2 are adjusted. As a result, it is possible to change the degree of electrical coupling between the first and the second signal contacts 3 and 4 and to adjust impedance upon transmission of the balanced signal.

Figure 6:
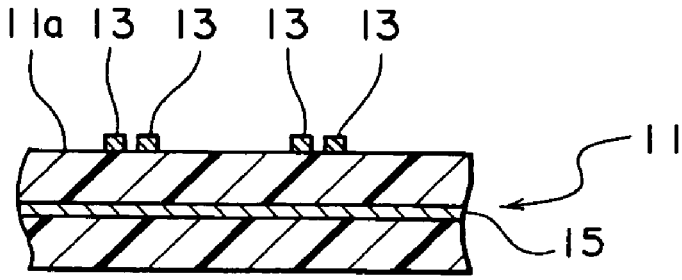
FIG. 6 is an enlarged sectional view taken along a line VI—VI in FIG. 1.
Figure 7:
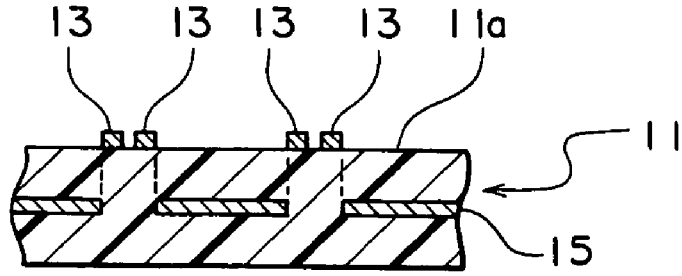
FIG. 7 is an enlarged sectional view taken along a line VII—VII in FIG. 1.

Next referring to FIGS. 6 and 7 in addition to FIGS. 1 and 2, the substrate 11 will be described.

The substrate 11 has a multilayer micro strip line structure. The substrate 11 has a surface 11*a* provided with a number of signal pads 12 corresponding to the terminal portions 3*f* and 4*f* of the first and the second signal contacts 3 and 4, a number of ground pads 13 connected to the signal pads 12, and a number of ground pads 14 corresponding to the ground contacts 5. Inside the substrate 11, a ground layer 1*t* extends in parallel to the surface 11*a*.

In FIG. 2, the substrate 11 is divided into two parts in a thickness direction. The ground layer 15 is formed in a hatched region in the figure. Thus, the ground layer 15 extends over an area except at least those portions faced to the signal pads 12 in the second direction A2. In other words, the ground layer 15 is locally removed at the portions located below the signal pads 12. With the above-mentioned structure, it is possible to suppress the decrease in impedance without increasing occurrence of crosstalk between the signal contact pairs.

As shown in FIG. 5, the terminal portions 3*f* and 4*f* of the signal contacts 3 and 4 are soldered to the signal pads 12 of the substrate 11 by SMT (surface mount technology), respectively. The terminal portions 5*b* of the ground contacts 5 are soldered to the ground pads 13, respectively.

While the present invention has thus far been described in conjunction with the preferred embodiment thereof, it will be readily possible for those skilled in the art to put this invention into practice in various other manners without departing from the scope set forth in the appended claims. For example, press punching may form each of the signal contacts.

What is claimed is:

1. A connector comprising an insulator and first and second signal contacts held by the insulator, each of the first and the second signal contacts comprising:

a fixed portion fixed to the insulator, a contacting portion connected to one end of the fixed portion and extending in a first direction;

a bent portion connected to the other end of the fixed portion;

a first intermediate portion extending from the bent portion in the first direction;

a second intermediate portion extending from the first intermediate portion in a second direction perpendicular to the first direction;

a terminal portion extending from the second intermediate portion in the first direction, the first intermediate portion of the first signal contact and the first intermediate portion of the second signal contact being placed at positions which are different from each other in the second direction, the second intermediate portion of the first signal contact and the second intermediate portion of the second signal contact being different from each other in the first direction, the bent portions being shaped to make the first and the second signal contacts be substantially equal in total length to each other;

wherein the first intermediate portion of the first signal contact and the first intermediate portion of the second signal contact are placed at positions which are different from each other in a third direction perpendicular to the first and the second directions, the second intermediate portion of the first signal contact and the second intermediate portion of the second signal contact are placed at positions which are different from each other in the third direction; and wherein the contacting portion of the first signal contact and the contacting portion of the second signal contact are faced to each other in the second direction.

2. The connector according to claim 1, wherein the first and the second signal contacts are used for transmission of a balanced signal.

3. A substrate to be connected to the connector according to claim 1, the substrate comprising:

a plate portion;

first and second signal pads disposed on a surface of the plate portion and adapted to be connected to the terminal portions of the first and the second signal contacts; and a ground layer formed inside the plate portion and extending in parallel to the surface of the plate portion over an area except at least those portions faced to the first and the second signal pads in the second direction.

4. The connector according to claim 1, wherein the contacting portion of the first signal contact and the contacting portion of the second signal contact are faced to each other in the second direction.

5. The connector according to claim 4, wherein the terminal portion of the first signal contact and the terminal portion of the second signal contact are disposed adjacent to each other in a third direction perpendicular to the first and the second directions.

6. The connector according to claim 1, further comprising a ground contact held by the insulator, a combination of the first and the second signal contacts forming a contact pair, the ground contact being disposed adjacent to the contact pair on one side of the contact pair in a third direction perpendicular to the first and the second directions.

7. The connector according to claim 6, wherein the ground contact extends in the first and the second directions in a plate-like shape.

8. The connector according to claim 6, further comprising an additional ground contact held by the insulator and disposed adjacent to the contact pair on the other side of the contact pair in the third direction.

9. The connector according to claim 8, wherein the additional ground contact extends in the first and the second directions in a plate-like shape.

* * * * *